US006023674A

United States Patent [19]

Mekuria

[11] Patent Number: 6,023,674

[45] Date of Patent: Feb. 8, 2000

[54] NON-PARAMETRIC VOICE ACTIVITY DETECTION

[75] Inventor: Fisseha Mekuria, Lund, Sweden

[73] Assignee: Telefonaktiebolaget L M Ericsson, Stockholm, Sweden

[21] Appl. No.: 09/012,518

[22] Filed: Jan. 23, 1998

[51] Int. Cl.[7] ..... G10L 7/08

[52] U.S. Cl. ..... 704/233; 704/207

[58] Field of Search ..... 704/233, 207, 704/206, 200, 201, 226, 222, 216, 217, 218, 210

[56] References Cited

U.S. PATENT DOCUMENTS

| | | | |
|---|---|---|---|
| 3,920,907 | 11/1975 | Mullen, Jr. et al. | 179/1 |
| 4,074,069 | 2/1978 | Tokura et al. | 179/1 |
| 4,164,626 | 8/1979 | Fette | 179/1 |
| 4,351,983 | 9/1982 | Crouse et al. | 395/2.42 |
| 4,672,669 | 6/1987 | DesBlache et al. | 381/46 |
| 4,720,802 | 1/1988 | Damoulakis et al. | 395/2.42 |
| 4,959,865 | 9/1990 | Stettiner et al. | 381/46 |
| 5,127,053 | 6/1992 | Koch | 381/31 |
| 5,255,340 | 10/1993 | Arnaud et al. | 395/2 |
| 5,276,765 | 1/1994 | Freeman et al. | 395/2.42 |
| 5,410,632 | 4/1995 | Hong et al. | 395/2.42 |
| 5,459,814 | 10/1995 | Gupta et al. | 395/2.42 |
| 5,509,102 | 4/1996 | Sasaki | 395/2.28 |
| 5,548,680 | 8/1996 | Cellario | 395/2.28 |
| 5,598,466 | 1/1997 | Graumann | 379/389 |
| 5,649,055 | 7/1997 | Gupta et al. | 395/2.42 |
| 5,657,422 | 8/1997 | Janiszewski et al. | 704/229 |
| 5,689,615 | 11/1997 | Benyassine et al. | 704/219 |
| 5,812,965 | 9/1998 | Massaloux | 704/205 |
| 5,835,851 | 11/1998 | Rasmusson et al. | 704/205 |
| 5,839,101 | 11/1998 | Vehatalo et al. | 704/226 |

OTHER PUBLICATIONS

"High–Quality Coding of Telephone Speech and Wideband Audio", Nikil Jayant, *Advances in Speech Signal Processing,* Marcel Dekker, Inc., New York, USA, 1992.

"Speech Enhancement in the 1980s: Noise Suppression with Pattern Matching", Steven F. Boll, *Advances in Speech Signal Processing,* Marcel Dekker, Inc., New York, USA, 1992.

European Transactions on Telecommunications and Related Technologies, vol. 5, No. 2, Mar./Apr. 1994, "The Pan–European Mobile Radio System Part II", L. Hanzo et al., pp. 261–276, XP000453467.

IEEE Transactions on Acoustics, Speech and Signal Processing, vol. ASSP–25, No. 6, Dec. 1977, ISSN 0096–3518, "A Pitch Extraction Algorithm Based on LPC Inverse Filtering and AMDF", Chong Kwan Un et al., pp. 565–572, XP002062146.

Noise Compensation Algorithms for Use With Hidden Markov Model Based Speech Recognition by Andrew Varga, Roger Moore, John Bridle, Keith Pointing and Martin Russell Speech Research Unit, Royal Signals and Radar Establishment St. Andrew's Road, Malvero, Worcestershire, Great Britian, 1988, BCC.

Low–Distortion Spectral Subtraction for Speech Enhancement by Peter Händel Proceedings of Eurospeech Conf., pp. 1549–1553, ISSN 1018–4074 (1995).

Suppression of Acoustic Noise in Speech Using Spectral Substraction by Steven F. Boll, Member, IEEE IEE Trans. on ASSP, pp. 113–120, vol. ASSP–27 (1979).

*Primary Examiner*—Richemond Dorvil
*Attorney, Agent, or Firm*—Jenkens & Gilchrist, P.C.

[57] ABSTRACT

Speech or voice activity in an audio signal is defected without using a speech coder. Pitch period information and signal energy information are extracted from the audio signal, and a decision regarding the presence or absence of voice is made based on that information.

19 Claims, 6 Drawing Sheets

NON-PARAMETRIC VOICE ACTIVITY DETECTION

CROSS REFERENCE TO RELATED APPLICATION

Subject matter of this application is related to subject matter disclosed in U.S. Ser. No. 08/917,224.

FIELD OF THE INVENTION

The invention relates to voice activity detection and, more particularly, to a voice activity detection technique that does not use a speech coder.

BACKGROUND OF THE INVENTION

Voice Activity Detection (VAD) is the art of detecting the presence of speech activity in noisy audio signals that are supplied to a microphone of a communication system. VAD systems are used in many signal processing systems for telecommunication. For example, in the Global System for Mobile communication (GSM), traffic handling capacity is increased by having the speech coders employ VAD as part of an implementation of the Discontinuous Transmission (DTX) principle, as described in the GSM specifications (particularly in GSM 06.10—fullrate speech transcoding; and in GSM 06.31—Discontinuous Transmission (DTX) for full rate speech traffic channel, May 1994). In noise suppression systems, such as in spectral subtraction based methods, VAD is used for indicating when to start noise estimation (and noise parameter adaptation). In noisy speech recognition, VAD is also used to improve the noise robustness of a speech recognition system by adding the right amount of noise estimate to the reference templates.

Next generation GSM handsfree functions are planned that will integrate a noise reduction algorithm for high quality voice transmission through the GSM network. A crucial component for a successful background noise reduction algorithm is a robust voice activity detection algorithm. The GSM-VAD algorithm has been chosen for use in the next generation hands-free noise suppression algorithms to detect the presence or absence of speech activity in the noisy audio signal coming from the microphone. If one designates s(n) as a pure speech signal, and v(n) as the background noise signal, then the microphone signal samples, x(n), during speech activity will be:

$$x(n)=s(n)+v(n), \tag{I}$$

and the microphone signal samples during periods of no speech activity will be:

$$x(n)=v(n). \tag{II}$$

The detection of states (I) and (II) described in the above equations is not trivial, especially when the speech/noise ratio (SNR) values of x(n) are low, such as occur in a car environment while driving on a highway.

The GSM VAD algorithm generates information flags indicating which state the current frame of audio signal is classified in. Detection of the above two states is useful in spectral subtraction algorithms, which estimate characteristics of background noise in order to improve the signal to noise ratio without the speech signal being distorted. See, for example, S. F. Boll, "Suppression of Acoustic Noise in Speech Using Spectral Subtraction", *IEEE Trans. on ASSP,* pp. 113–120, vol. ASSP-27 (1979); J. Makhoul & R. McAulay, *Removal of Noise From Noise-Degraded Speech Signals,* National Academy Press, Washington, D.C. (1989); A. Varga, et al., "Compensation Algorithms for HMM Based Speech Recognition Algorithms", *Proceedings of ICASSP-88*, pp. 481–485, vol. 1 (1988); and P. Händel, "Low Distortion Spectral Subtraction for Speech Enhancement", *Proceedings of EUROSPEECH Conf.*, pp. 1549–1553, ISSN 1018-4074 (1995).

The GSM VAD algorithm utilizes an autocorrelation function (ACF) and periodicity information obtained from a speech coder for its operation. As a consequence, it is necessary to run the speech coder before getting any noise-suppression performed. This situation is illustrated in FIG. 1. The digitized microphone signal samples, x(k), are supplied to a speech coder 101, which in turn generates autocorrelation coefficients (ACF) and long term predictor lag values (pitch information), $N_p$, as specified by GSM 06.10. The ACF and $N_p$ signals are supplied to a VAD 103. The VAD 103 generates a VAD decision that is supplied to one input of a spectral subtraction-based adaptive noise suppression (ANS) unit 105. A second input of the ANS 105 receives a delayed version of the original microphone signal samples, x(n). The output of the ANS 105 is a noise-reduced signal that is then supplied to a second speech coder 107, or fed back to speech coder 101 for coding and transmission of the speech information.

From the above discussion, it is apparent that the GSM VAD algorithm disadvantageously requires the execution of the whole speech coder in order to be able to extract the short term autocorrelation and long term periodicity information that is necessary for making the VAD decision.

The periodicity information in the speech coder is calculated by a long term predictor using cross correlation algorithms. These algorithms are computationally expensive and incur unnecessary delay in the hands-free signal processing. The requirement for a simple periodicity detector gets more acute with the next generation coders (such as GSM's next generation Enhanced Full Rate (EFR) coder) which consume a large amount of memory and processing capacity (i.e., the number of instructions that need to be performed per second) and which add a significant computational delay compared to GSM's current Full Rate (FR) coders.

The utilization of the periodicity and ACF information from the speech coder 101 by the VAD decision in the noise reduction algorithm is a costly method with respect to delay, computational requirements and memory requirements. Furthermore, the speech coder has to be run twice before a successful voice transmission is achieved. The extraction of periodicity information from the signal is the most computationally expensive part. Consequently, a low complexity method for extracting the periodicity information in the signal is needed for efficient implementation of the background noise suppression algorithm in the mobile terminals and accessories of the future.

Conventional periodicity detectors are primarily based on analog processing of the signals, and fail to take into account the problems of material fading and slow processing time. They use computationally expensive techniques designed to process input signals that consist only of clean signals with no additive noise.

Other conventional periodicity detectors use the standard GSM type pitch detectors based on linear predictive coding (LPC) modeling of the input signal. These techniques, which suffer from the problems identified above, also fail to adapt the processing to the time varying nature of the signal, but instead use estimation model parameters (like the LPC order, frame length, and the like) that are not time-varying.

It is therefore desirable to provide voice activity detection without the aforementioned disadvantages.

The present invention provides voice activity detection without the aforementioned disadvantageous need for modeling information from speech coders.

DETAILED DESCRIPTION

Figure 1:
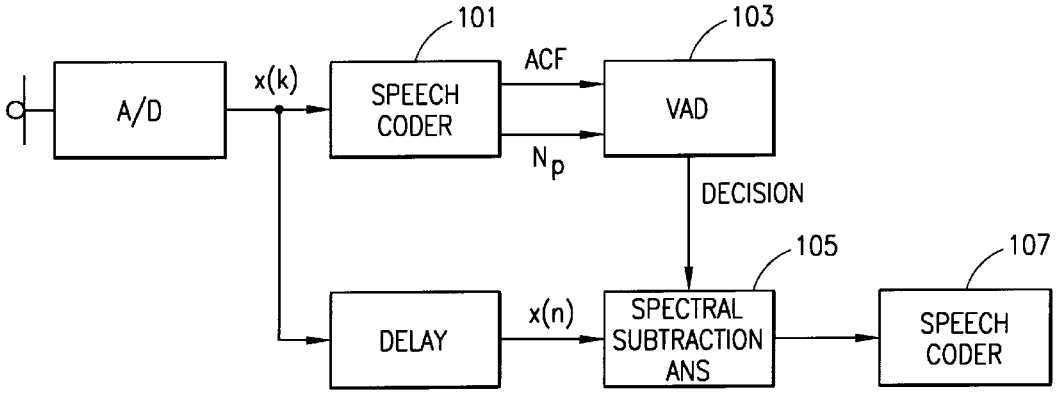
FIG. 1 (PRIOR ART)
FIG. 1 illustrates a conventional voice activity detection scheme.
Figure 2:
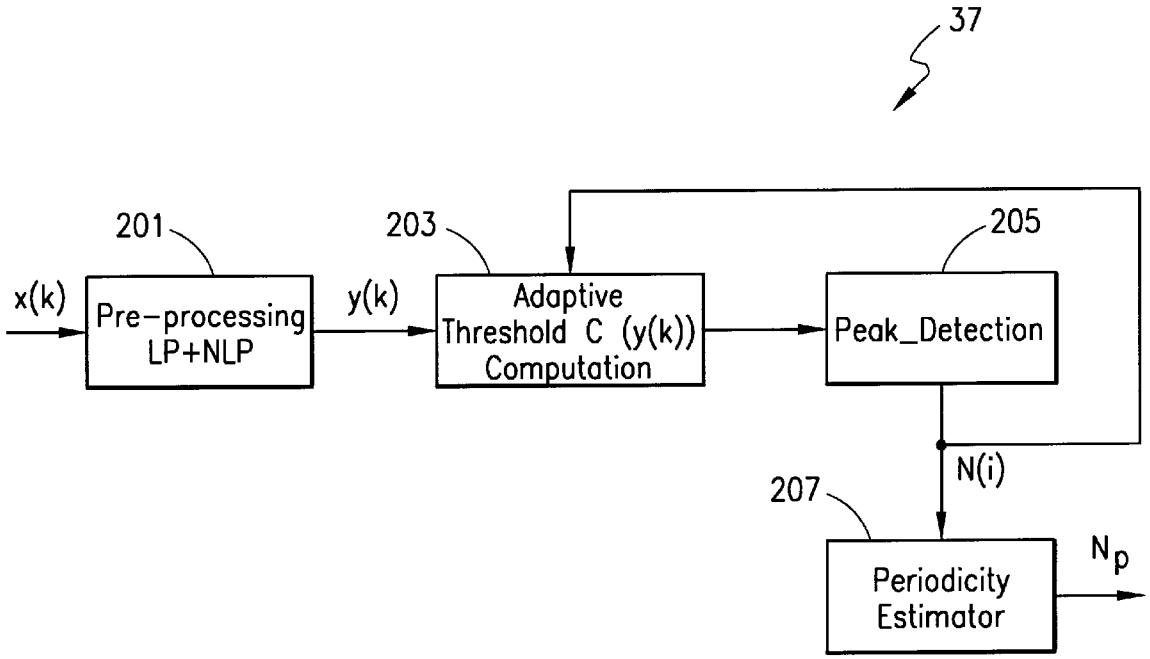
FIG. 2 illustrates a waveform based periodicity detector according to the present invention.

An exemplary embodiment of a periodicity detector 37 according to the invention is shown in FIG. 2. A system as shown in FIG. 2 could, for example, be implemented by a programmable processor such as a digital signal processor (DSP) running a program that has been written in C-source code or assembler code.

In accordance with one aspect of the invention, periodicity detection is based on a short time waveform pitch computation and long time pitch period comparison. Referring now to FIG. 2, the discrete audio signal, x(k), is first run through a pre-processing stage 201 composed of a low pass filter (LP) and non-linear signal processing block (NLP) to highlight the speech pitch tracks. The purpose of the LP filter is to extract the pitch frequency signals from the noisy speech. Since pitch frequency signals in speech are found in the range of 200–1000 Hz, the LP filter cutoff frequency range is preferably chosen to be in the range of 800–1200 Hz.

The non-linear processing function is preferably in accordance with the following equation:

$$y(k)=\beta*[x(k)]^n \text{ if } x(k)\geqq 0$$

$$0 \text{ if } x(k)<0$$

The values for n and β are preferably selected from a look-up table as a function of the signal to noise ratio (SNR) of the noisy input signal. The SNR could be measured in the pre-processing stage 201 and the fixed table values may be determined from empirical experiments. For low SNR values (e.g., 0–6 dB in a car environment), a larger value of n is used to enhance the peaks while a lower value of β is used to avoid overflow during computation. For high SNR values, the reverse strategy applies (i.e., lower values of n and higher values of β are used).

The pre-processing stage 201 simplifies the subsequent periodicity detection and increases robustness. The output of the pre-processing stage 201 is supplied to an adaptive threshold computation stage 203, whose output is in turn supplied to a peak detection stage 205. The adaptive threshold computation stage 203 and peak detection stage 205 detect waveform segments containing periodicity (pitch) information. The purpose of the adaptive threshold computation stage 203 is to suppress those peaks in the preprocessed signal that do not contain information about the pitch period of the input signal. Thus, those portions of the preprocessed signal having a peak magnitude below an adaptively determined threshold are suppressed. The output of the adaptive threshold computation stage 203 should have peaks that are spaced apart by the pitch period. The job of the peak detection stage 205 is to determine the number of samples between peaks in the signal that is provided by the adaptive threshold computation stage 203. This number of samples, designated as N, constitutes a frame of information.

The adaptive threshold computation stage 203 generates an output, C(y(k)), in accordance with the following equation:

$$C(y(k)) = \begin{cases} y(k) & \text{if } y(k) \geq V_{th}(i) \\ 0 & \text{if } y(k) < V_{th}(i) \end{cases}$$

It can be seen that for samples of y(k) whose magnitude exceeds the magnitude of the threshold value $V_{th}$, the adaptive threshold computation stage 203 generates an output equal to the input y(k). For samples of y(k) whose magnitude is less than the magnitude of the threshold value $V_{th}(i)$, the output is zero. In a preferred embodiment, C(y(k)) is always a positive value because the output of the preprocessing stage 201, y(k), is itself always positive.

The threshold level, $V_{th}(i)$ is preferably generated from the input y(k) values in accordance with the following equation:

$$V_{th}(i) = \frac{G(i)}{N(i)} \sum_{k=0}^{N(i)-1} y(k)$$

where G(i) is a scaling factor at time i, and N(i) is the frame length of frame i. The values N(i), G(i) and, consequently, $V_{th}(i)$ vary from frame to frame as a function of the noisy input signal's magnitude and spectral non-stationary (i.e., the degree to which the probability density function (pdf) of the signal changes over time). For each frame, the value of N(i) is provided as a feedback signal from the peak detection stage 205. The value of G(i) is adjusted according to a look-up table as a function of changes in N(i). The fixed G(i) table values are determined empirically. Generally, they take on values between 0 and 1, and react inversely to changes in N(i). For the first frame, a guessed value of G(0) may be used. Subsequently, the feedback values of N(i) may be compared with an expected average pitch period for speech signals (e.g., a number of samples corresponding to 20 msec). Then, if the value of N(i) is greater than the expected average value, the value of G(i) is decreased. Similarly, if the value of N(i) is less than the expected average value, then the value of G(i) is increased. In this way, the output of the adaptive threshold computation stage 203 is adaptively adjusted so that peaks of the input signal that do not contain the pitch period information are suppressed without also affecting parts of the signal that do contain the pitch period information. This adaptive tracking of signal information aids in achieving robust periodicity detection.

As stated above, the peak detection stage 205 receives the C(y(k)) values from the adaptive threshold computation stage 203, and measures the period between detected peaks. The output of the peak detection stage 205, N(i), is the number of samples between the detected peaks.

N(i) is supplied to a periodicity estimate stage 207, which generates the periodicity information, $N_p$, by averaging several (e.g., three or four) values of N(i), and checking whether the values of $N_p$ are close to expected average values of pitch period. In an alternative embodiment of the invention, the periodicity estimate stage 207 also checks the individual values of N(i) in order to avoid using an erroneous value that will detrimentally affect the average periodicity estimate $N_p$.

Figure 3A:
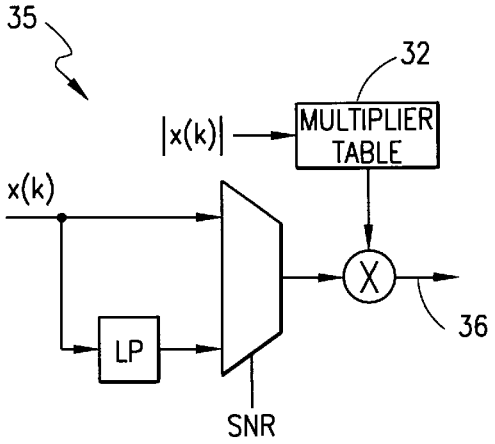
FIG. 3A illustrates the soft threshold section of FIG. 3 in greater detail.
Figure 3B:
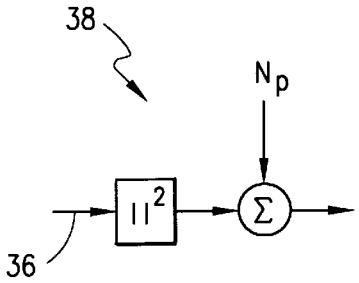
FIG. 3B illustrates the squared magnitude estimation section of FIG. 3 in greater detail.
Figure 3:
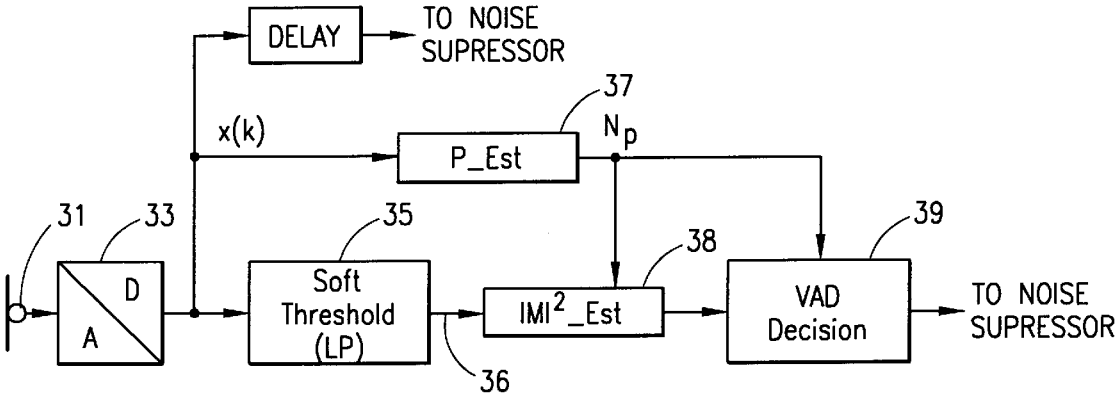
FIG. 3 illustrates a non-parametric voice activity detector according to the present invention.

FIG. 3 illustrates an exemplary non-parametric VAD 30 according to the present invention. The VAD 30 is described as non-parametric because, as shown below, it does not use information or parameters generated by a speech coder, in contrast to prior art approaches.

Figure 4:
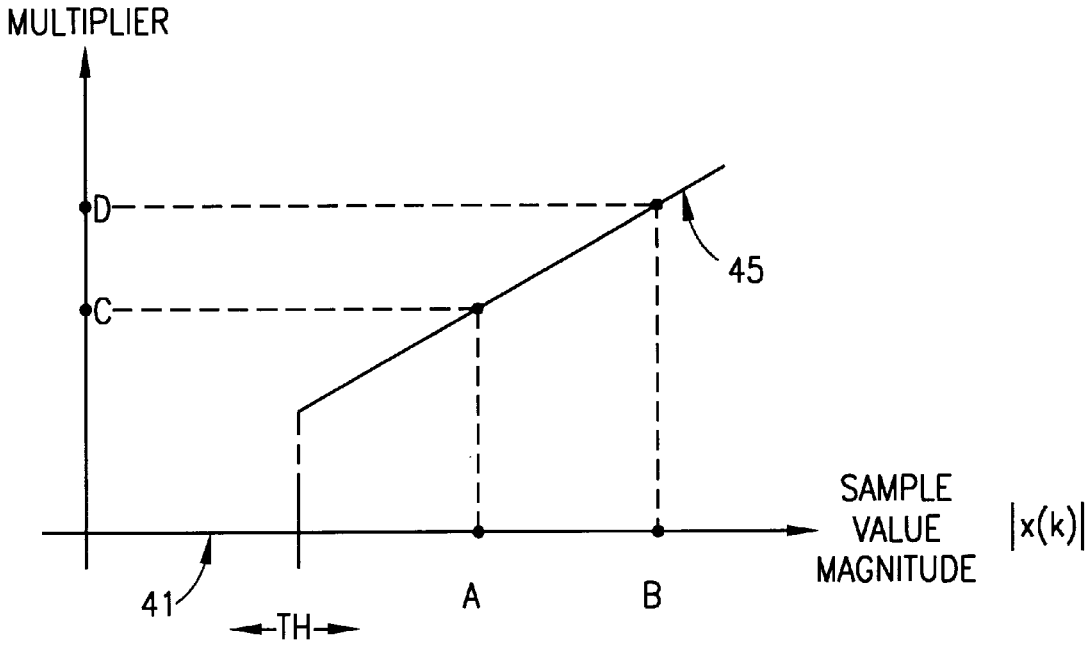
FIG. 4 illustrates the operation of a lookup table in the soft threshold function of FIG. 3.

The signal from the microphone 31 is input to an A/D converter 33 whose digitized output x(k) is input to a soft threshold stage 35 and is also input to the waveform periodicity detector of FIG. 2, indicated at 37 and designated P_Est in FIG. 3. The soft threshold function at 35 is well-known in the art. In particular, the soft threshold stage 35 compares a threshold value, TH in FIG. 4, with the magnitudes of the digitized samples that constitute the A/D converter output x(k). Those samples whose magnitude is less than the threshold value TH, indicated at 41 in FIG. 4, are multiplied by 0, or alternatively, a very small multiplier value in order to suppress those samples. Those samples whose magnitudes are above the threshold value TH are multiplied by a multiplier value which increases linearly with increasing sample value magnitudes. This is illustrated at 45. In FIG. 4, a sample value magnitude of A will produce multiplier value C, and a sample value magnitude of B will produce multiplier value D. The multiplier values can be readily accessed from a lookup table.

The threshold value TH and the multiplier values are empirically determined from long term analyses of voice signals in various different environments and noise backgrounds. For example, a first threshold value and a first set of multipliers could be used for an automobile environment, and a second threshold value and a second set of multipliers could be used for an office environment. The desired threshold and set of multipliers can be pre-programmed during manufacturing, or can be selected by the user to correspond to the current environment. The threshold value TH may also be advantageously varied with the signal to noise ratio (SNR).

The above-described soft thresholding function 35 prevents small noisy components from entering the squared magnitude estimation function at 38. The soft thresholding function 35 also includes an optional low pass (LP) filter for use at very low signal to noise ratio (SNR) values. When the soft thresholding function detects a very low SNR value (e.g. 0–6 dB in a car environment), which detection is a well-known conventional technique, the digital signal x(k) is passed through the low pass filter (example cutoff frequency range of 800–1200 Hz) before reaching the soft thresholding function.

The above-described soft threshold stage 35 is illustrated diagrammatically in FIG. 3A. The LP filter is switched in by the SNR trigger, and the multiplier value is obtained from the table 32 based on the magnitude of x(k) or LP filtered x(k).

The squared magnitude estimation stage 38 (|M|_$^2$Est) receives at 36 the output samples from the soft threshold function 35, and operates on those samples under control of $N_p$ output from the waveform periodicity detection function 37. For a number of samples equal to the average number ($N_p$) of samples between detected peaks, the squared magnitude estimation function squares the magnitude of each sample and then calculates the sum of the squared magnitudes. It will be recognized that the squared magnitude of a sample provides a measure of the signal energy associated with the sample, so that the signal processing path through the soft threshold and squared magnitude stages at 35 and 38 ultimately extracts signal energy information from x(k).

The above-described squared magnitude estimation stage 38 is illustrated diagrammatically in FIG. 3B. The magnitudes of the soft threshold output samples at 36 are squared, and then $N_p$ determines how many squared magnitudes are to be summed.

Figure 5:
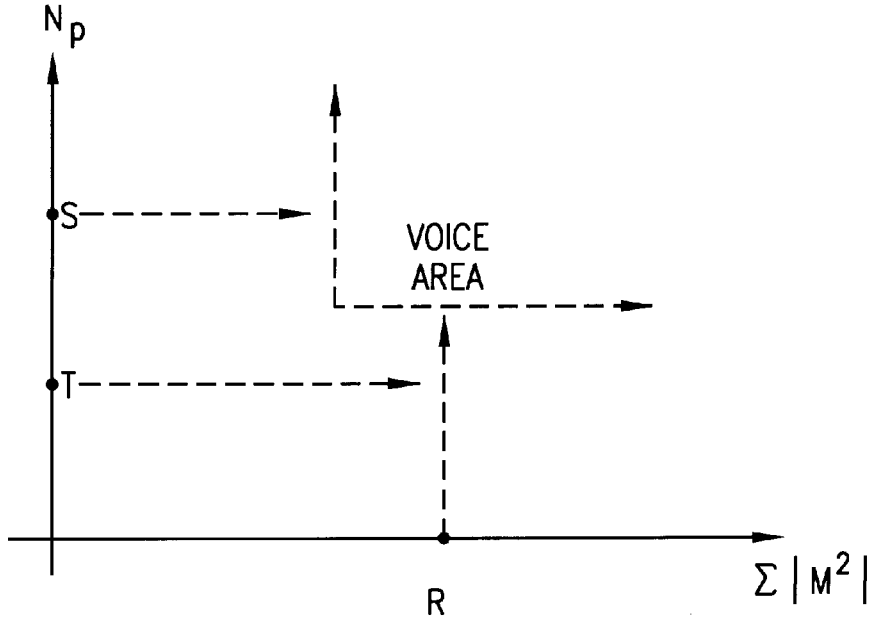
FIG. 5 illustrates the operation of a lookup table in the VAD decision function of FIG. 3.

The output of the squared magnitude estimation stage 38 is input along with $N_p$ to a VAD decision stage 39. The VAD decision function at 39 determines the presence or absence of voice. Referencing example FIG. 5, the sums of the squared magnitudes and $N_p$ are used to determine the presence or absence of voice. In the example case shown in FIG. 5, if a squared magnitude sum of R and an $N_p$ value of S are used to enter a lookup table, the lookup table will indicate the presence of voice (see Voice Area in FIG. 5), but a squared magnitude value of R and an $N_p$ value of T will yield a table value that indicates the absence of voice. The values in the VAD decision lookup table can be determined empirically from long term analyses in the particular environments of operation.

In the example of FIG. 3, the output of VAD decision stage 39 is provided to a noise suppressor along with a delayed version of x(k). If the VAD decision is affirmative, then the noise suppressor is enabled. The VAD decision output may also be provided to other functions as mentioned below.

Figure 7:
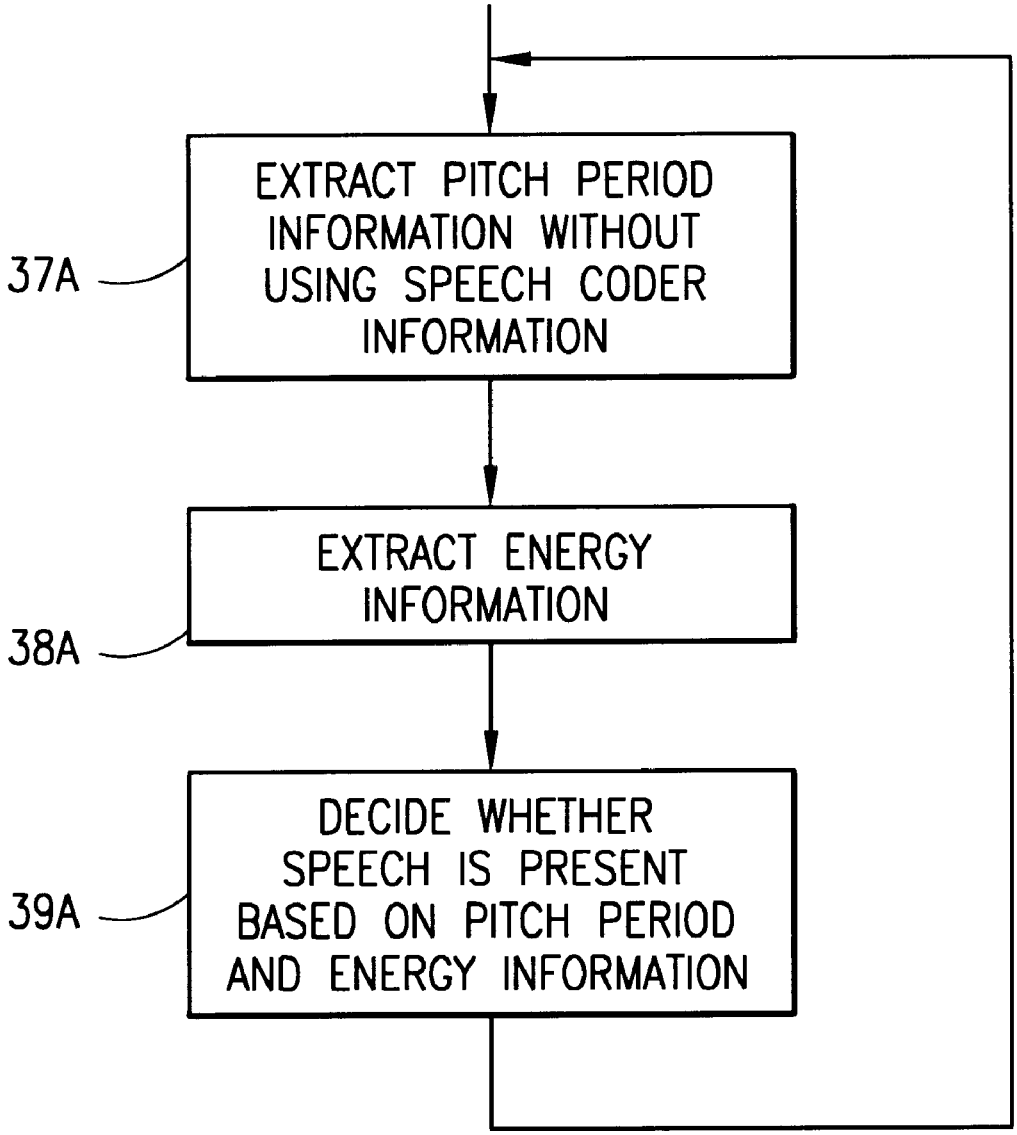
FIG. 7 illustrates the components of a voice activity detection process implemented by the voice activity detector of FIG. 3.

The above-described non-parametric VAD thus makes the voice decision (39 in FIG. 3) based on two waveform parameters derived from a short time analysis of the noisy speech signal, namely pitch periodicity (37 in FIG. 3) and signal energy (35 and 38 in FIG. 3). These components of the decision process are also illustrated in exemplary FIG. 7, and are designed therein by the same reference numerals as in FIG. 3, but with "A" appended thereto.

The above-described non-parametric VAD provides robust voice detection and removes the need for modeling information from speech coders. Such a non-parametric VAD with its low complexity and flexibility can be used in acoustic echo cancelers, noise suppression, and voice recognition algorithms without the need to operate the speech coders in a mobile terminal. The non-parametric VAD has low computational complexity, and can be readily implemented, for example, in software within the digital signal processor (DSP) of a mobile telecommunications terminal. This is illustrated in example FIG. 6. Also typically programmed in the DSP are other functions requiring a VAD, such as a noise suppressor NS, voice dialer or the double talk detector for an acoustic echo canceler AEC. Workers in the art will also recognize that the non-parametric VAD can alternately be readily implemented in hardware or as a combination of hardware and software.

Figure 6:
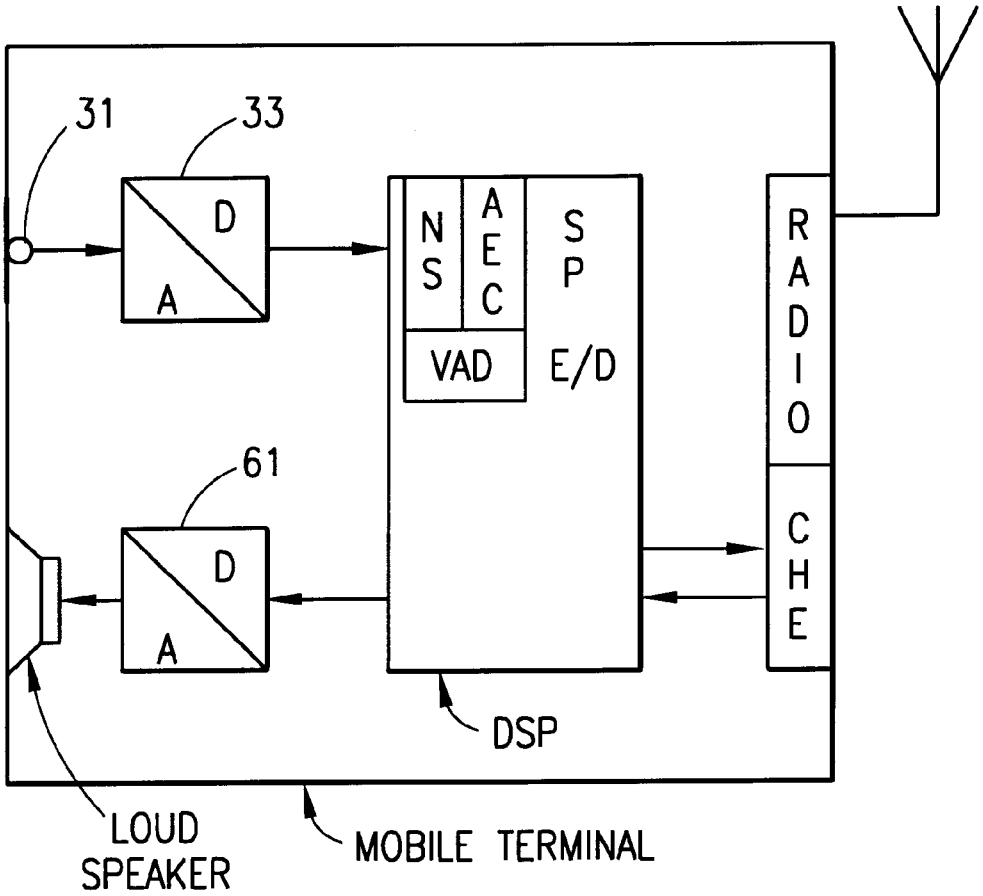
FIG. 6 illustrates a mobile telecommunications terminal according to the present invention.

Also shown in the mobile terminal example of FIG. 6 are a speech encoder/decoder SPE/D, a channel encoder CHE, a radio transceiver RADIO, a D/A converter 61 and a loudspeaker.

Although exemplary embodiments of the present invention have been described above in detail, this does not limit the scope of the invention, which can be practiced in a variety of embodiments.

What is claimed is:

1. A method of detecting a speech component signal in an audio signal, comprising:

extracting from the audio signal information about a pitch period of the speech component signal without using information obtained from a speech coder;

extracting signal energy information from the audio signal; and deciding whether the speech component signal is present in the audio signal based on the information about the pitch period and the signal energy information.

2. The method of claim 1, wherein said first-mentioned extracting step includes processing the audio signal to produce a signal having peaks that are separated by the pitch period of the speech component signal.

3. The method of claim 2, wherein said processing step includes applying low pass and non-linear filtering to the audio signal to remove from the audio signal information that is not indicative of the pitch period.

4. The method of claim 1, wherein said last-mentioned extracting step includes suppressing first signal values of the audio signal that are less than a predetermined threshold value, and multiplying second signal values of the audio signal that exceed the predetermined threshold value by respective multiplier values that vary as a function of the second signal values.

5. The method of claim 4, wherein said last-mentioned extracting step includes squaring the magnitudes of the multiplied second signal values.

6. The method of claim 5, wherein said last-mentioned extracting step includes dividing the squared magnitude values into groups, and summing the squared magnitude values of each group.

7. The method of claim 6, wherein said dividing step includes selecting members for each group based on the information about the pitch period.

8. The method of claim 4, wherein said last-mentioned extracting step includes low pass filtering the audio signal before performing said suppressing and multiplying steps, and performing said suppressing and multiplying steps on the low pass filtered audio signal.

9. The method of claim 4, wherein the multiplier values vary linearly with the second signal values.

10. An apparatus for detecting a speech component signal in an audio signal, comprising:

a pitch period detector which extracts from the audio signal information about a pitch period of the speech component signal without using information obtained from a speech coder;

a signal energy detector which extracts signal energy information from the audio signal; and a decision section that is connected to said pitch period detector and to said signal energy detector and which decides whether the speech component signal is present in the audio signal based on the information about the pitch period and the signal energy information.

11. The apparatus of claim 10, wherein said pitch period detector includes a signal processing section that processes the audio signal to produce a signal having peaks that are separated by the pitch period of the speech component signal.

12. The apparatus of claim 11, wherein said signal processing section includes a low pass filter section and a non-linear filter section which remove from the audio signal information that is not indicative of the pitch period.

13. The apparatus of claim 10, wherein said signal energy detector includes a multiplier that (1) suppresses first signal values of the audio signal that are less than a predetermined threshold value and (2) multiplies second signal values of the audio signal that exceed the threshold value by respective multiplier values that vary as a function of the second signal values.

14. The apparatus of claim 13, wherein said signal energy detector includes a magnitude squaring section that squares the magnitudes of said multiplied second signal values, said magnitude squaring section connected to said multiplier.

15. The apparatus of claim 14, wherein said signal energy detector includes a summing section that operates on a group of said squared magnitude values and sums said group of squared magnitude values, said summing section connected to said squaring section.

16. The apparatus of claim 15, wherein said summing section is also connected to said pitch period detector to receive said information about said pitch period for defining said group of squared magnitude values.

17. The apparatus of claim 13, including a low pass filter which is selectively connectable to an input of said multiplier for low pass filtering said audio signal and passing a low pass filtered audio signal to said multiplier.

18. The apparatus of claim 13, wherein the multiplier values vary linearly with the second signal values.

19. A mobile telecommunications terminal, comprising:

a microphone for receiving an input audio signal; a digitizer coupled to said microphone for digitizing the audio signal; and an apparatus coupled to said digitizer for detecting a speech component signal in the digitized audio signal, said apparatus including a pitch period detector which extracts from the digitized audio signal information about a pitch period of the speech component signal without using information obtained from a speech coder, a signal energy detector which extracts signal energy information from the digitized audio signal, and a decision section that is connected to said pitch period detector and to said signal energy detector and which decides whether the speech component signal is present in the digitized audio signal based on the information about the pitch period and the signal energy information.

* * * * *